US008341889B2

(12) United States Patent
Faulkner et al.

(10) Patent No.: US 8,341,889 B2
(45) Date of Patent: Jan. 1, 2013

(54) COUPLING APPARATUS FOR BARRIER ASSEMBLIES AND RELATED METHODS

(75) Inventors: James Faulkner, Seattle, WA (US); Steven A. Carlsen, Bothell, WA (US); Keith A. Mullins, Kent, WA (US); Brian G. Denault, Seattle, WA (US)

(73) Assignee: Hy-Security Gate, Inc., Kent, WA (US)

( * ) Notice: Subject to any disclaimer, the term of this patent is extended or adjusted under 35 U.S.C. 154(b) by 409 days.

(21) Appl. No.: 12/562,743

(22) Filed: Sep. 18, 2009

(65) Prior Publication Data

US 2010/0071264 A1 Mar. 25, 2010

Related U.S. Application Data

(60) Provisional application No. 61/098,590, filed on Sep. 19, 2008.

(51) Int. Cl.
*E05F 11/28* (2006.01)

(52) U.S. Cl. ..... 49/345; 339/340

(58) Field of Classification Search ..... 49/339, 49/340, 345; 403/147, 201, 253, 254, 270, 403/290, 304, 368, 374.1, 374.2, 374.3, 374.4
See application file for complete search history.

(56) References Cited

U.S. PATENT DOCUMENTS

| | | | | |
|---|---|---|---|---|
| 3,079,181 | A * | 2/1963 | Van Der Wissel | 285/333 |
| 3,422,486 | A | 1/1969 | Thomas, Jr. | |
| 4,106,657 | A | 8/1978 | Dogliotti et al. | |
| 4,330,958 | A * | 5/1982 | Richmond | 49/280 |
| 4,429,264 | A * | 1/1984 | Richmond | 318/466 |
| 4,474,264 | A | 10/1984 | Krause | |
| 4,735,018 | A * | 4/1988 | Duncan et al. | 49/340 |
| 4,850,094 | A * | 7/1989 | Lybecker | 29/434 |
| 4,906,147 | A * | 3/1990 | Friesinger et al. | 409/232 |
| 5,025,531 | A | 6/1991 | McCarty et al. | |
| 5,131,204 | A * | 7/1992 | Hiendl | 52/848 |
| 5,175,903 | A * | 1/1993 | Curtis | 15/250.34 |
| 5,190,393 | A * | 3/1993 | Svensson | 403/370 |
| D349,034 | S | 7/1994 | Webster | |
| 5,538,356 | A * | 7/1996 | Aarre et al. | 403/371 |
| 5,607,249 | A * | 3/1997 | Maughan | 403/165 |
| D397,026 | S | 8/1998 | Drake | |
| 5,954,157 | A | 9/1999 | Grimes et al. | |
| 5,964,635 | A * | 10/1999 | Krog | 446/120 |

(Continued)

FOREIGN PATENT DOCUMENTS

DE 3615200 A1 * 11/1987

(Continued)

OTHER PUBLICATIONS

U.S. Appl. No. 29/343,828, filed Sep. 18, 2009, Faulkner, James.
U.S. Appl. No. 29/363,533, filed Jun. 10, 2010, Faulkner, James.

*Primary Examiner* — Jerry Redman
(74) *Attorney, Agent, or Firm* — Perkins Coie LLP

(57) ABSTRACT

The present disclosure relates generally to barrier assemblies, and more particularly, to the coupling of a barrier operator to the barrier that the operator is to move. In one embodiment, a barrier operator coupling includes a wedge member that is fixedly attached to an output shaft of the barrier operator. A housing is brought to bear against a wedge member, and an adjustment device is used to maintain the force between the wedge member and the housing.

24 Claims, 14 Drawing Sheets

U.S. PATENT DOCUMENTS

| | | | | |
|---|---|---|---|---|
| 6,045,291 | A * | 4/2000 | Ruehle et al. | 403/297 |
| 6,256,928 | B1 * | 7/2001 | Skeem | 49/341 |
| D446,441 | S | 8/2001 | Brake | |
| 6,463,828 | B1 * | 10/2002 | Soucek | 74/594.1 |
| 6,631,820 | B2 | 10/2003 | Harrold et al. | |
| 6,712,544 | B2 * | 3/2004 | Kruger et al. | 403/408.1 |
| D523,729 | S | 6/2006 | Gorst | |
| 7,396,050 | B2 * | 7/2008 | Marioni | 285/235 |
| D589,781 | S | 4/2009 | Lee | |
| 7,587,861 | B2 * | 9/2009 | Bongard | 49/394 |
| 2002/0178655 | A1 * | 12/2002 | Pedemonte | 49/339 |

FOREIGN PATENT DOCUMENTS

| | | | |
|---|---|---|---|
| EP | 615819 | A1 * | 9/1994 |
| JP | 02147466 | A * | 6/1990 |

* cited by examiner

COUPLING APPARATUS FOR BARRIER ASSEMBLIES AND RELATED METHODS

CROSS-REFERENCE TO RELATED APPLICATIONS

The present application claims priority to and incorporates by reference in its entirety U.S. Provisional Patent Application No. 61/098,590 entitled "A COUPLING APPARATUS FOR BARRIER ASSEMBLIES AND RELATED METHODS" filed Sep. 19, 2008.

TECHNICAL FIELD

The present disclosure relates generally to barrier assemblies, and more particularly, to the coupling of a barrier operator to the barrier that the operator is to move.

BACKGROUND

Most generally available barrier assemblies provide some sort of coupling between the barrier and the barrier operator mechanism that is intended to perform at least one of the following functions: to protect the barrier operator mechanism from being damaged by a mechanical overload; and to allow disconnection of the barrier from the barrier operator in the event manual movement of the barrier is needed.

It is not uncommon for barriers to encounter obstructions or be hit by vehicles. Swing gate operators, for instance are particularly susceptible to damage from vehicles. Conventional hinged swing gate installations include a gate connected via linkage to an operator that opens and closes the gate. When an object, such as a vehicle, hits a swing gate, very large torques can be generated at the operator's output shaft by way of the force imparted on crank arm, which can result in damage to the operator.

The current state of the art in coupling of an operator to crank arms on barrier operators is shown in FIGS. 1-3. Referring to FIGS. 1-3, a barrier operator has a barrier operator coupling 100 that consists of a journal 110, which is attached to a gearbox 111, a crank arm 112, clamp halves 113 and 116, a bolt 114, and a release handle 115. The assembly of clamp halves 113 and 116 is releasably mountable on the journal 110 with the bolt 114. The release handle 115 is attached to the clamp halves 113 and 116 and configured to move the clamp halves toward and away from each other to form an adjustable clamp 117 that attaches to the journal 110 (as shown, e.g., in FIG. 4). By adjusting the release handle 115, it is possible to adjust the tightness of the bolt 114, which in turn adjusts the tightness of the clamp 117. Further, it is possible to loosen the release handle 115 and manually open the barrier if required. In addition, barriers can vary widely in their weight and length or width. Because the rate at which the barrier can be accelerated is dependent on the inertia of the barrier, barrier operators are typically designed to accommodate the largest inertial load they are specified to accommodate. This leads to sub-optimal motion where smaller, lighter barriers are moved, or compromised operator life where barriers at the limits of specification are moved.

SUMMARY

The following summary is provided for the benefit of the reader only and is not intended to limit the disclosure in any way. In one embodiment, the improved design is a barrier operator coupling that offers consistent breakaway torque in response to an overload condition that is easy to adjust, requires no tools, and is less vulnerable to corrosion. An apparatus for coupling the output of a barrier operator to the associated barrier is described herein and provides consistent overload protection to the barrier operator. In one embodiment, the coupling is used to couple a barrier operator to the barrier linkage. This arrangement has application in a general sense for providing overload protection and/or manual release for substantial any configuration of barrier and operator.

According to a particular embodiment, a conical journal having a frustoconical shape defining a wedge member is fixedly attached to an output shaft of a barrier operator. A housing having a female frustoconical bore is brought to bear against a wedge member. An adjustment device is used to maintain the normal force between the tapered outer surface of the wedge member and the inner surface of the bore in the housing. This adjustment device may vary by application, but one of the simplest form is that of an adjustment bolt.

In another aspect of the disclosure, the choice of materials of the wedge member and the housing are selectable depending on application. In one embodiment, for example, the wedge member and the housing can be made form two different materials each having a different hardness such that galling is reduced.

In still another aspect of the disclosure, the adjustment device has an arrangement of an adjustment bolt, a biasing member, and a flat washer. The adjustment device is positioned over portions of the wedge member and the housing such that water ingress into the frictional interface between the two parts is minimized, thereby minimizing the opportunity for corrosion to take place.

An improved barrier operator may also contain a feature for entering information relating to the inertial load of the barrier, and adjusting the rates of acceleration and deceleration and speed to optimize the motion profile and thus minimize the time to open or close.

DETAILED DESCRIPTION

The present disclosure describes barrier assemblies, and more particularly, the coupling of a barrier operator to the barrier that the operator is to move. Certain specific details are set forth in the following description and FIGS. 4 through 20 to provide a thorough understanding of the various embodiments of the disclosure. Well-known structures, systems, and methods often associated with such systems have not been shown or described in detail to avoid unnecessarily obscuring the description of various embodiments of the disclosure. In addition, those of ordinary skill in the relevant art will understand that additional embodiments of the disclosure may be practiced without several of the details described below.

Figure 1:
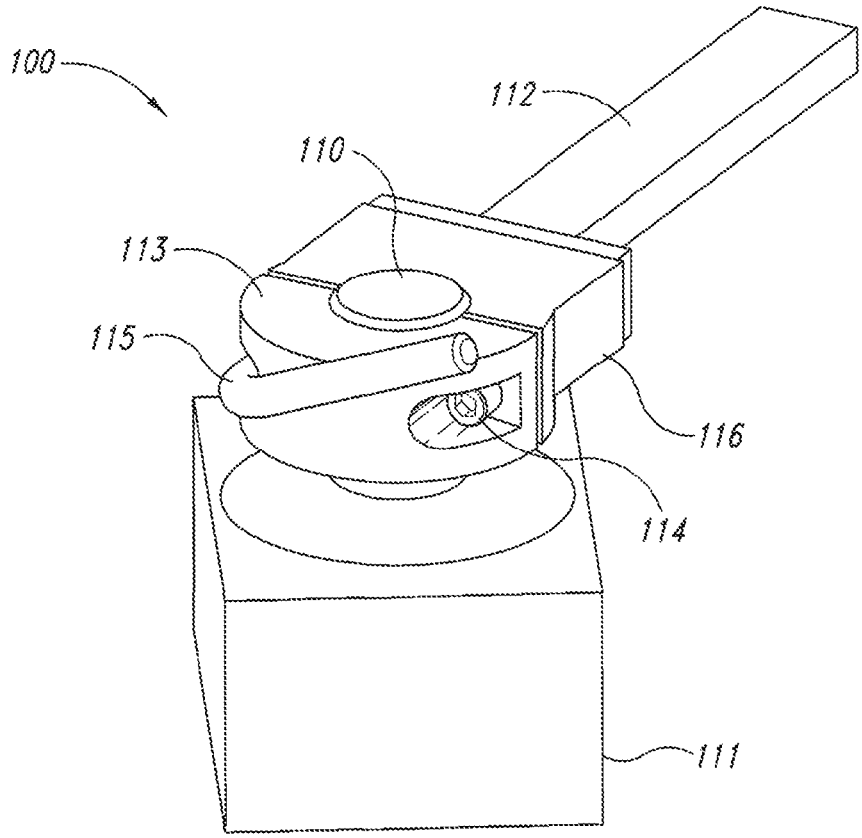
Fig. 1 (Prior Art)
FIG. 1 is a perspective view of a prior art barrier operator coupling.
Figure 2:
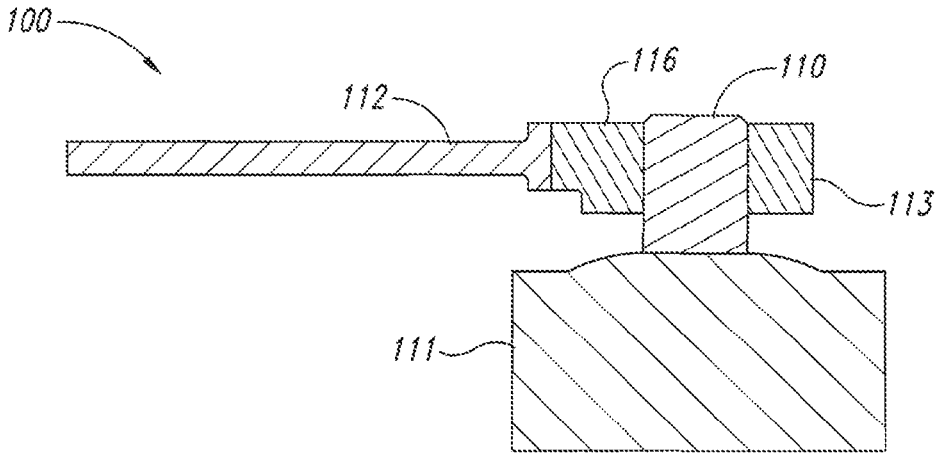
Fig. 2 (Prior Art)
FIG. 2 is a sectional view of a prior art barrier operator coupling.
Figure 3:
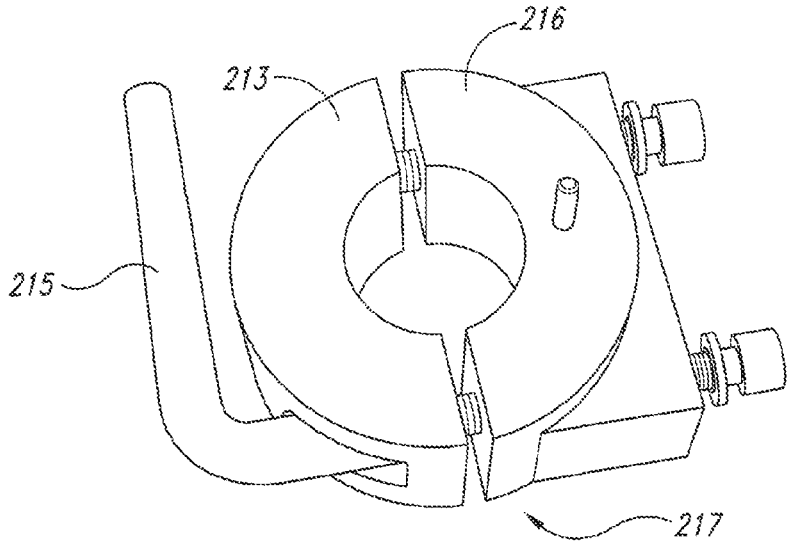
Fig. 3 (Prior Art)
FIG. 3 is a top view of a prior art barrier operator coupling.
Figure 4:
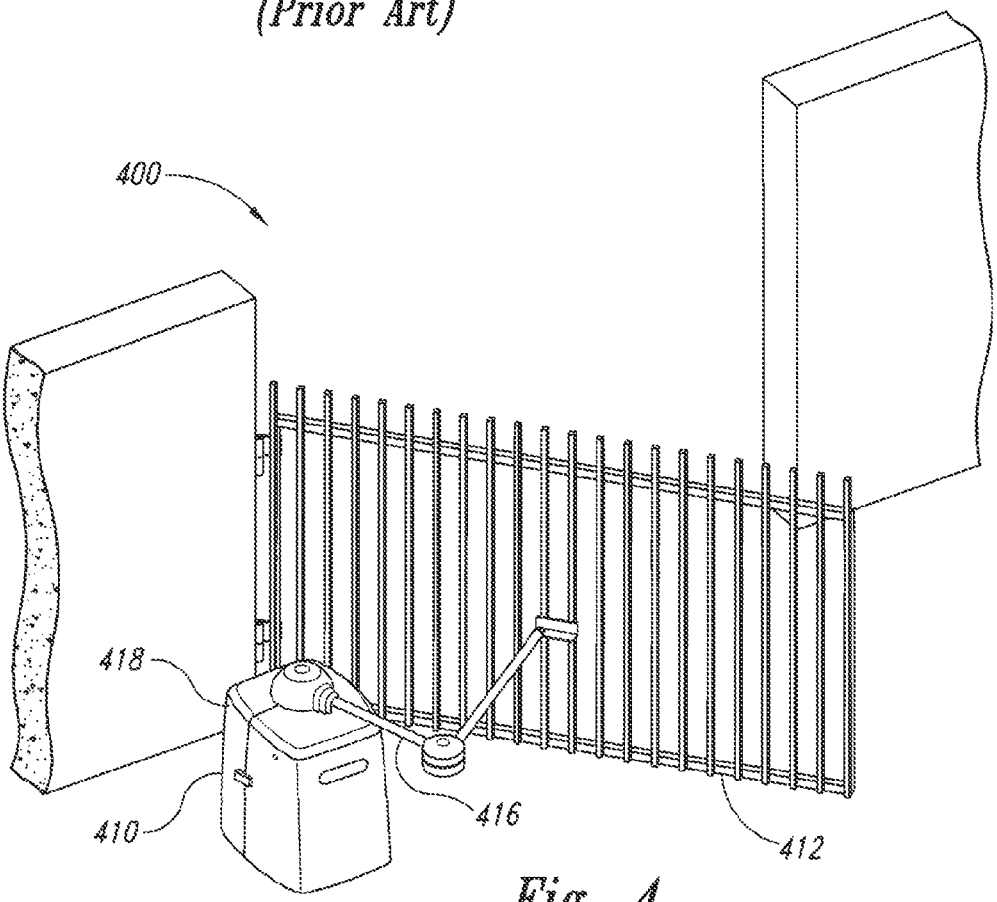
FIG. 4 is a perspective view of a barrier installation with a swing gate, a linkage, and a barrier operator configured in accordance with an embodiment of the disclosure.

Referring to FIG. 4, a barrier operator installation 400 according to one application of the disclosure is shown. A barrier (e.g., a gate) 412 is connected to an operator 410 with a crank arm 416 and linkage 417. A motor 418 in the operator supplies mechanical energy through the crank arm 416 and linkage 417 to move the barrier 412 between open and closed positions. It can be seen that a vehicle hitting the barrier 412 is capable of generating very large torques at the operator output shaft by way of the force imparted on the crank arm 416, which can result in damage to the operator 410.

Figure 5:
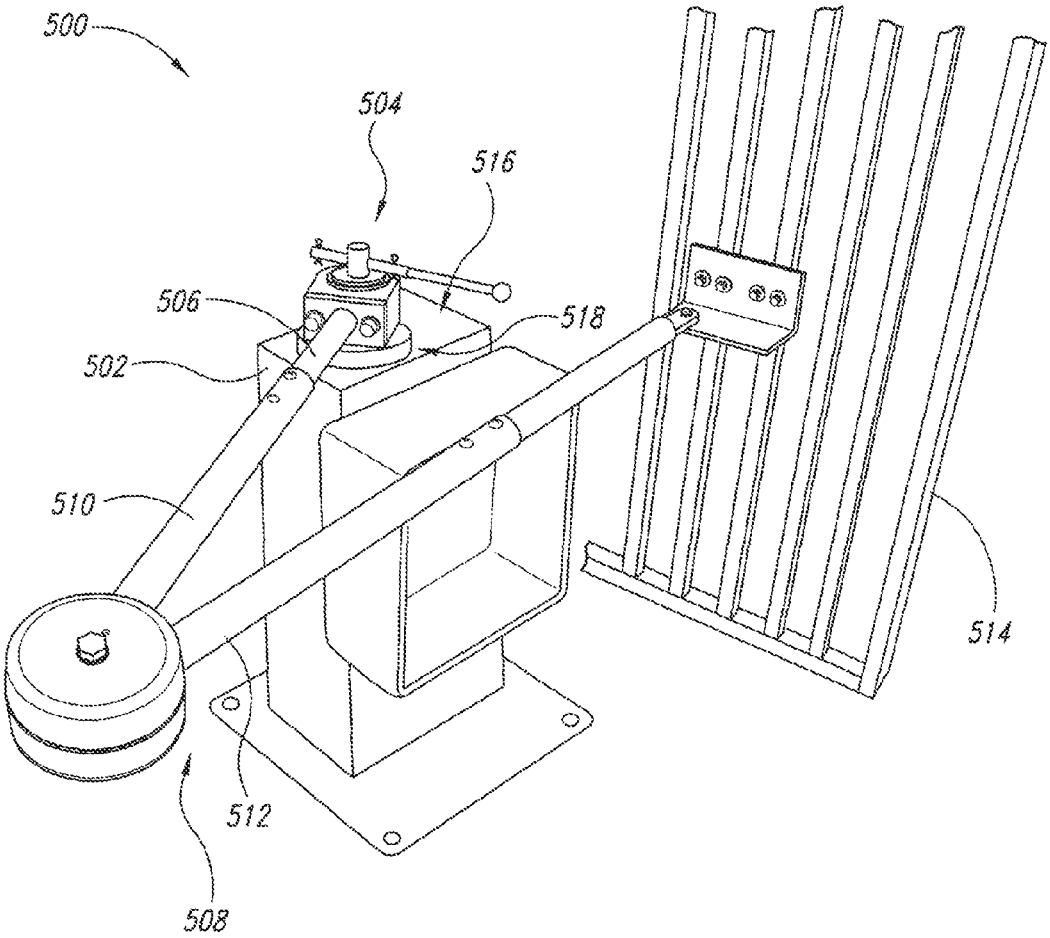
FIG. 5 is a perspective view of a barrier operator according to one embodiment of the disclosure.

Referring to FIG. 5, a barrier operator installation 500 in accordance with some embodiments of the disclosure is shown. The barrier installation 500 includes a barrier operator 502, a barrier operator coupling 504 having a crank arm 506. The crank arm 506 is connected to a barrier linkage 508 having a first barrier arm 510 and a second barrier arm 512. The first barrier arm 510 is connected at one end to the crank arm 506 and pivotably connected on the other end to the second barrier arm 512. The second barrier arm 512 is connected to a barrier 514. The barrier 514 may be a swing gate or any other type of pivoting barrier.

The barrier operator 502 has a motor 516 and torque multiplication device 518 to supply mechanical energy to move the barrier operator coupling 504, thereby moving the barrier 514 between the open and closed positions. The barrier operator coupling 504 is located between the torque multiplication device 518 and the barrier 514 and is configurable to allow slippage within the barrier operator coupling 504 at a predetermined torque level to avoid damage to the barrier operator 502, the barrier linkage 508, or the barrier 514 under high torque conditions, such as from a vehicle hit or other loads applied to the barrier 514. Specific features of the barrier operator coupling 504 are described below.

Figure 6:
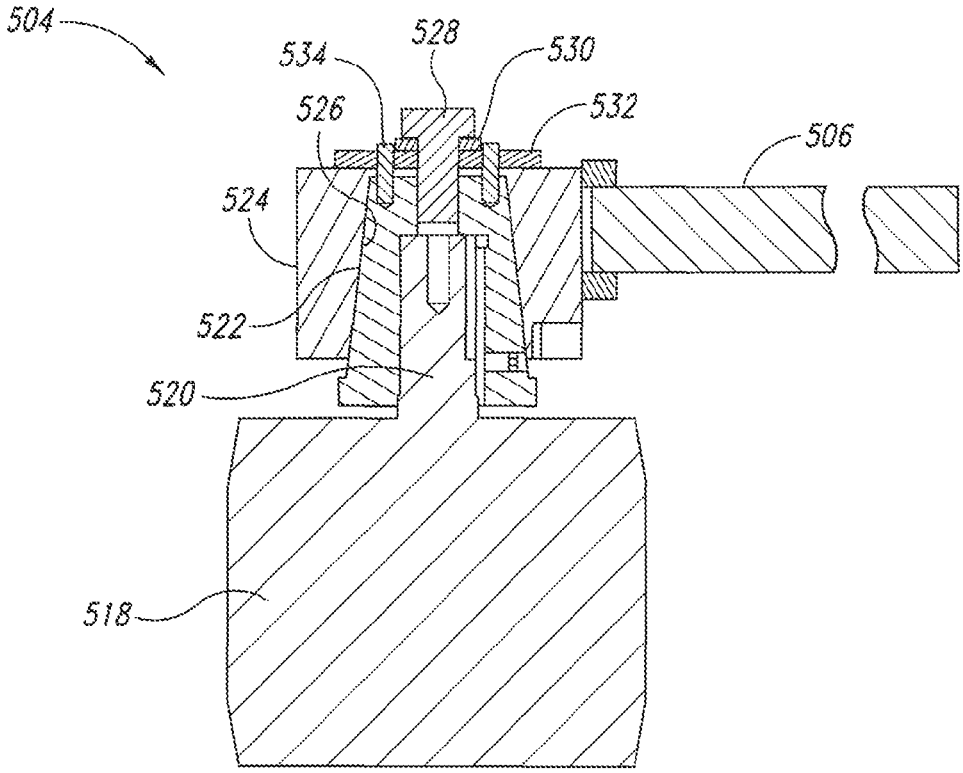
FIG. 6 is a sectional view of an embodiment of the disclosure.

Referring to FIG. 6, a sectional view of the barrier operator coupling 504 is shown. In one embodiment, the barrier operator coupling 504 includes the torque multiplication device 518 having an output shaft 520. In the embodiment shown in FIG. 6, the torque multiplication device 518 is a gear box, but in other embodiments other devices for multiplying torque generated by the motor 516 may be used. Secured on the output shaft 520 is a male frustoconical journal which acts as a wedge member 522. The wedge member 522 has a particular cone angle $\alpha$ as described later in FIG. 9. The wedge member 522 engages at a wedge interface with a housing 524 which contains a female frustoconical bore 526 configured to receive the wedge member 522. The bore 526 has a corresponding cone angle matching the cone angle $\alpha$ of the wedge member 522. The housing 524 of the illustrated embodiment is connected directly to the crank arm 506, thereby transmitting torque from the torque multiplication device 518 through the barrier operator coupling 504 to the crank arm 506.

In some embodiments, an adjustment device 528, shown in the illustrated embodiment as an adjustment bolt, is threaded into the wedge member 522 and transmits axial force through a spring washer 530 and a flat washer 532 that bears against the housing 524. One or more pins 534 or other locking device(s) serve to ensure that the assembly of the flat washer 532, the spring washer 530, and the adjustment device 528 do not rotate relative to the wedge member 522 in the event that the wedge member 522 slips and rotates relative to the housing 524. The embodiment shows two pins; however different numbers of pins or other anti-rotation devices can be used in different embodiments. The spring washer 530 can take the form of a spring, a spring disk, or any other device which provides preloading to the flat washer 532. The axial force transmitted by the adjustment device 528 causes the necessary friction for the housing 524 to engage with the wedge member 522. The axial force may be adjusted by tightening or loosening the adjustment device 528 relative to the wedge member 522 thereby changing the tension of the spring washer 530 or the force on which the spring washer 530 bears against the housing 524. The wedging interface configuration between the wedge member 522, the housing, 524, and the adjustment device 528 provides an embodiment that enables fine tuning of the barrier operator coupling 504. In other embodiments, the presence of spring washer 530 and the flat washer 532 is not required.

In some embodiments the flat washer 532 can be configured to provide additional frictional resistance. For example, the flat washer 532 can be made from a material with a relatively high coefficient of friction, such as steel or other suitable materials. Alternatively a suitable material could be attached to the bottom of the flat washer 532. Accordingly, the frictional engagement between the flat washer 532 and the housing 524 can be used to control the amount of torque needed to cause slippage within the barrier operator coupling 504.

Figure 7:
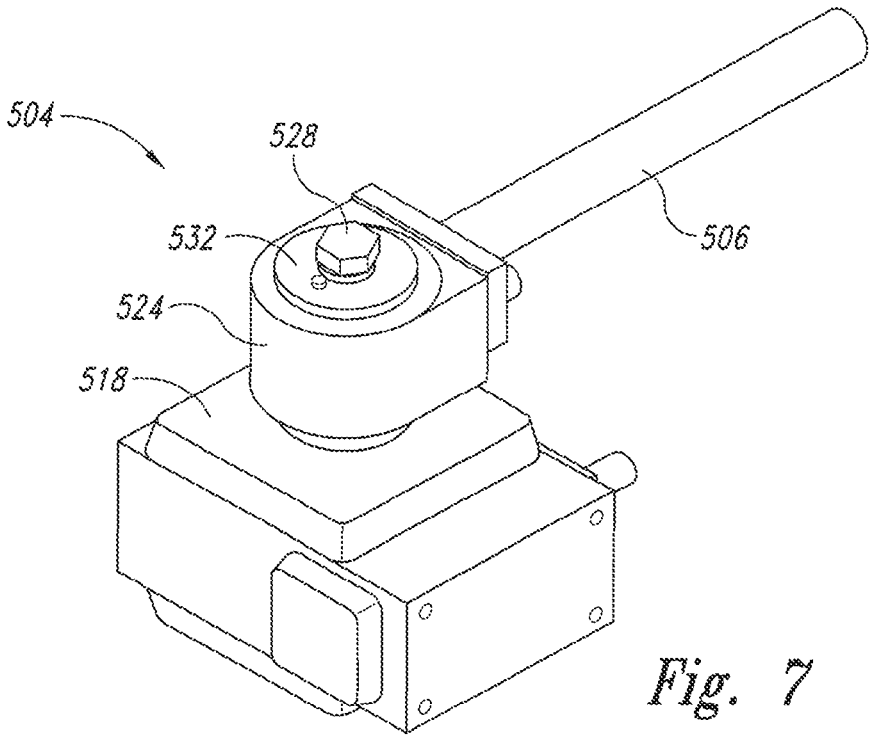
FIG. 7 is a perspective view of an embodiment of the disclosure.

FIG. 7 shows a perspective view of the embodiment from FIG. 6. The housing 524 is shown covering the wedge member 522. The flat washer 532 is shown pushed against the housing 524 by the adjustment device 528. In this embodiment, the adjustment device 528 is a simple bolt (e.g., an adjustment bolt). The tightness of the adjustment device 528 and the force it exerts on the spring washer 530 and flat washer 532 can be adjusted using conventional tools known in the art. In other embodiments discussed below, the adjustment device 528 can include other features which allow adjustment without tools.

Figure 8:
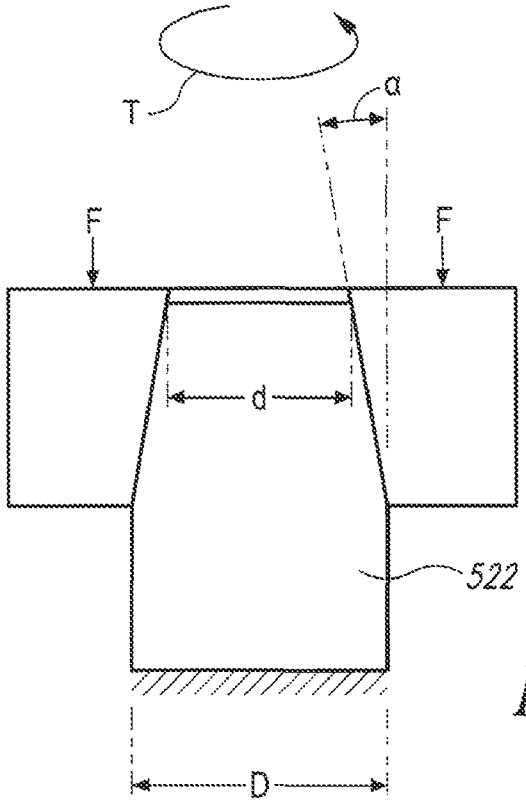
FIG. 8 is a view showing the dimensions and forces acting on a barrier operator coupling according to an embodiment of the disclosure.

Referring to FIG. 8, a view showing the dimensions and forces acting on the barrier operator coupling 504 is depicted. If one assumes the shape of the wedge member 522 to be fixed, the maximum amount of torque that can be transmitted T by the coupling is given by the equation:

$$T = \frac{Ff}{4\sin\alpha}(D + d)$$

Where:

T=maximum amount of torque transmitted by the barrier operator coupling 504, indicated by "T" in FIG. 8;

F=axial force between the wedge member 522 and the housing 524, indicated by "F" in FIG. 8;

f=static coefficient of friction between the wedge member 522 and the housing 524;

α=cone angle, indicated by "α" in FIG. 8;

D=larger of diameters defining conical shape, indicated by "D" in FIG. 8; and d=smaller of diameters defining conical shape, indicated by "d" in FIG. 8.

Slippage may occur when there is not sufficient frictional resistance between the wedge member 522 and the housing 524 to resist the torsional forces applied to the housing 524 (e.g., via the crank arm 506 from FIG. 5) or to the wedge member 522 (e.g., via the motor 516 from FIG. 5). Adjustment of the adjustment device 528 can increase the normal force between the surfaces of the wedge member 522 and the housing 524, thereby increasing the torque required to overcome the frictional engagement of the components and reduce the likelihood of slippage within the boundaries of the barrier operator coupling 504. It should be noted that once slippage takes place, the torque is determined by the same equation, with the exception that the coefficient of friction, f, is now the dynamic coefficient for the two materials, typically a relatively lower number, yielding a lower torque transmitted.

In one embodiment, it is desirable to select different materials having a different hardness for the wedge member 522 and the housing 524. For example, one piece can be made of a material such as aluminum or bronze while the other can be made from a material such as steel. It makes no difference which of the members contains the harder of the two materials. Specific features of the wedge member 522 and the housing 524 are described below.

Figure 9:
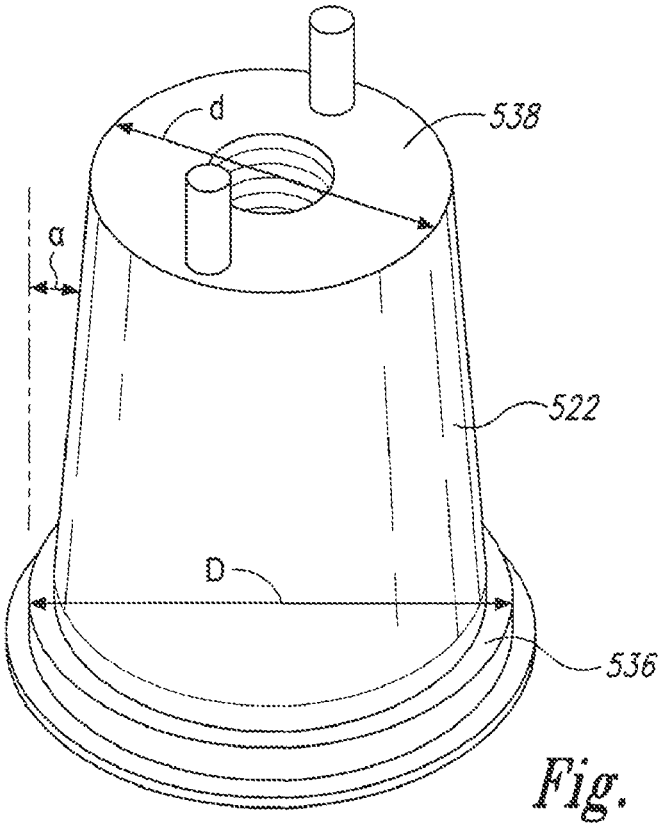
FIG. 9 is a perspective view of a wedge member according to an embodiment of the disclosure.

Referring to FIG. 9, a perspective view of the wedge member 522 according to an embodiment of the disclosure is shown. In this embodiment, the wedge member 522 has a generally frustoconical shape with a larger diameter D at the bottom 536 and a smaller diameter d at the top 538. The wedge member 522 has an axis A positioned perpendicular to the bottom at the outer edge of the cone. The walls of the wedge member extend at a cone angle α. In some embodiments the cone angle α is between approximately 5-10 degrees, inclusive. In one embodiment, the cone angle α is approximately 7.5 degrees.

Figure 10:
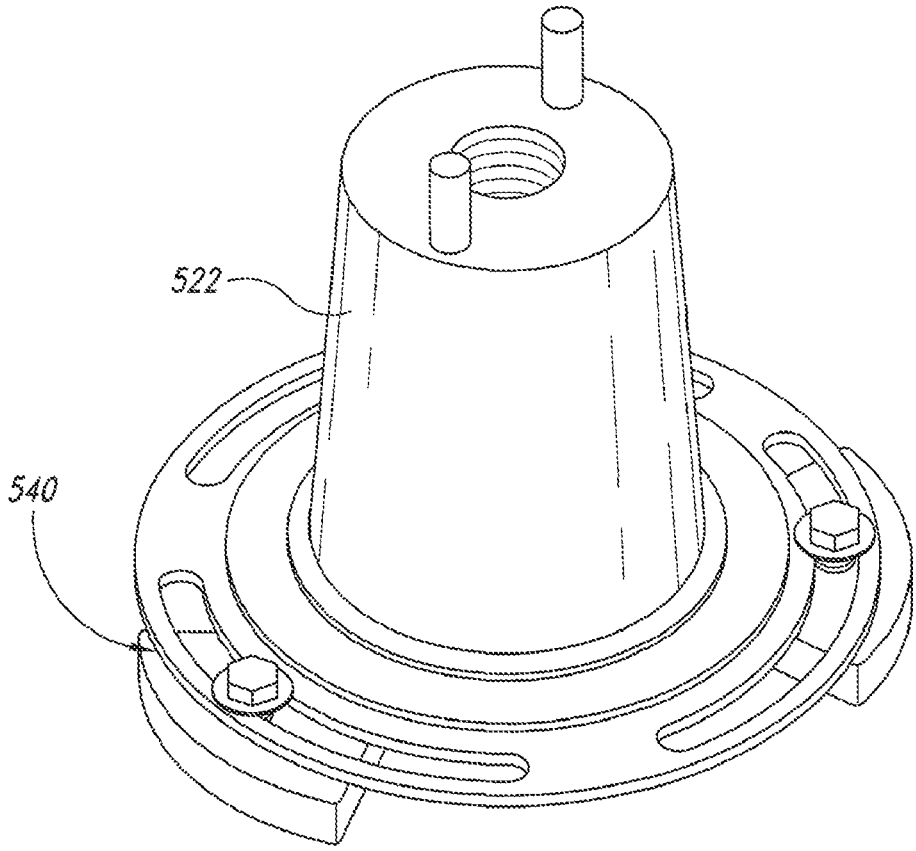
FIG. 10 is another perspective view of a wedge member according to an embodiment of the disclosure.

Referring to FIG. 10, the wedge member 522 is adjacent to a limit switch 540 coupled to the housing 524. The function of the limit switch 540 is to interface with a control system (not shown) which monitors the position of the crank arm 506 (shown in FIGS. 5-7) relative to the open and closed positions.

Figure 11:
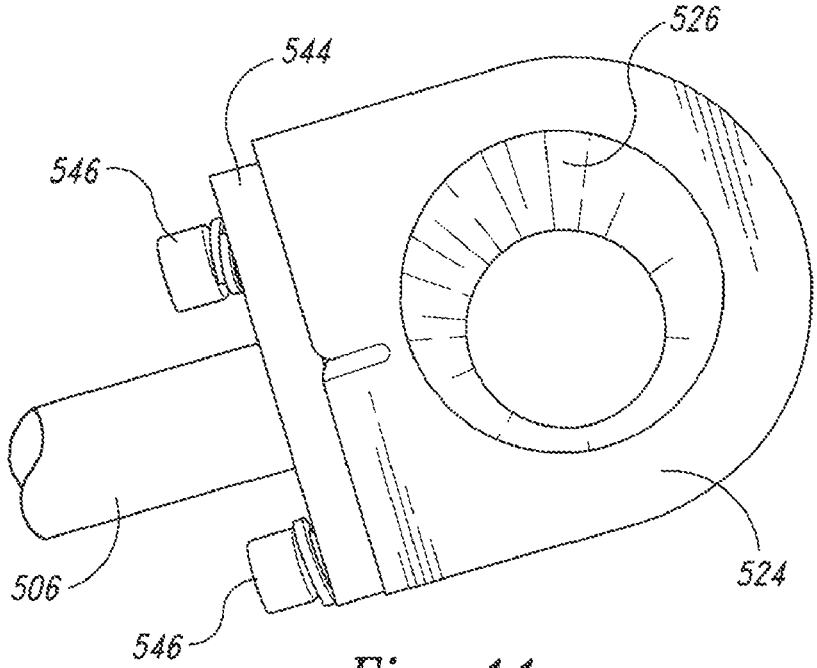
FIG. 11 is a perspective view of a housing according to an embodiment of the disclosure.

Referring to FIG. 11, an embodiment of the housing 524 is shown. In some embodiments, the housing 524 is a one-piece structure. In other embodiments, the housing 524 may be made from one or more separate pieces. A single piece housing as shown in FIG. 11 provides a smooth and consistent interface between the housing 524 and the wedge member 522 without any breaks or joints in the surface forming the female frustoconical bore 526 within the housing 524. This smooth, consistent interface can preserve the life of the wedge member 522 by reducing breakage and other damage. In the embodiment shown, the crank arm 506 is shown attached to the housing 524 with a plate 544 and bolts 546 and 548.

Figure 12:
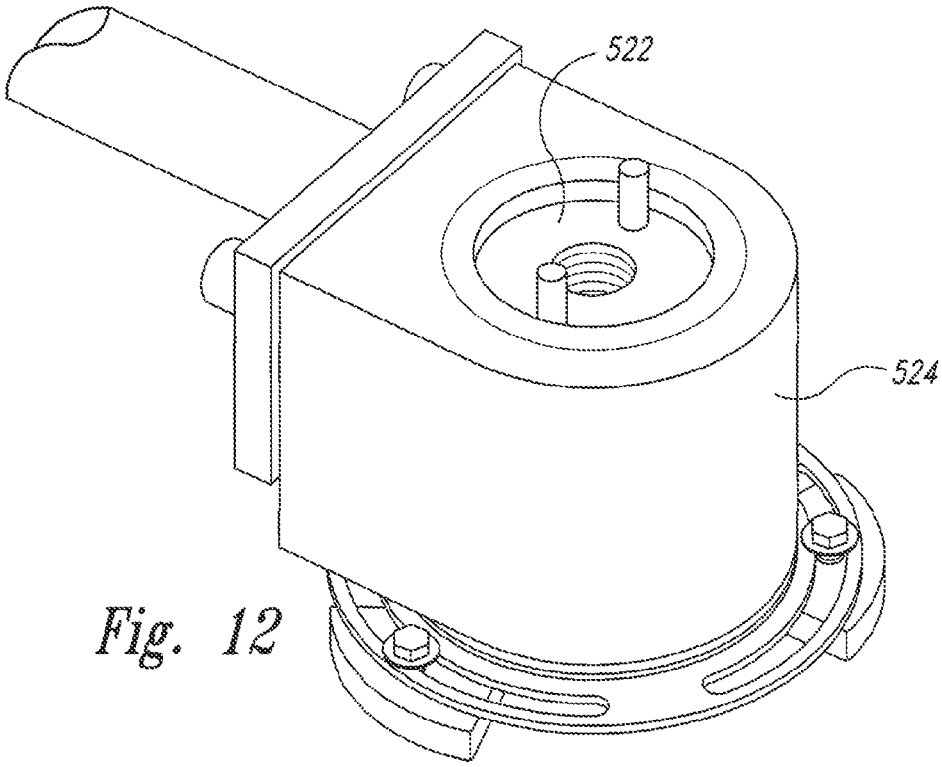
FIG. 12 is a perspective view of a wedge member and housing according to an embodiment of the disclosure.

FIG. 12 shows the housing 524 coupled to wedge member 522 according to one embodiment of the disclosure. The top of the wedge member 522 is recessed relative to the top of the housing 524 to allow for axial displacement of the wedge member 522 relative to the housing 524 upon tightening of the adjustment device 528. In other embodiments, the top of the wedge member 522 may be positioned at the same level as the top of the housing 524. In one embodiment, a wear sleeve (not shown) may be positioned between the housing 524 and the wedge member 522. The wear sleeve can be made from a material such as steel and offers additional protection to preserve the life of the wedge member 522. If the wear sleeve is damaged, it can be easily and quickly replaced.

Figure 13:
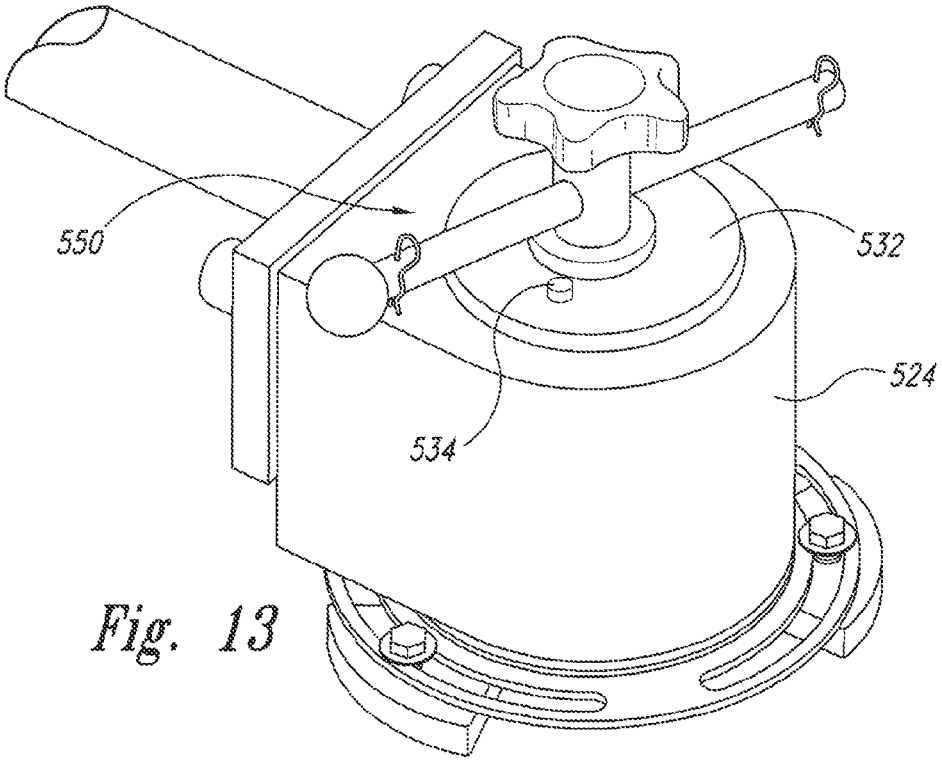
FIG. 13 is a perspective view of a wedge member, housing, and adjustment device according to an embodiment of the disclosure.

Referring to FIG. 13, a tool-free adjustment device 550 of another embodiment is shown attached the housing 524. The flat washer 532 is arranged between the adjustment device 550 and the housing 524. Pins 534 ensure that the flat washer 532 and the adjustment device 550 do not rotate relative to the wedge member 522. Specific features of the adjustment device 550 are described below.

Figure 14:
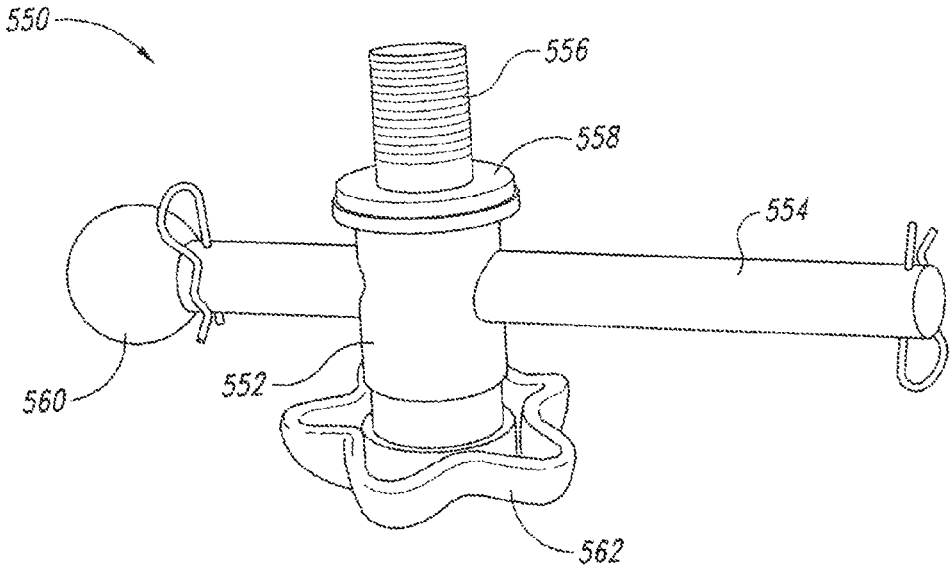
FIG. 14 is a perspective view of an adjustment device an embodiment of the disclosure.

FIG. 14 shows a detailed perspective view of an embodiment of the adjustment device 550. In some embodiments the adjustment device 550 includes an intermediate portion 552, an adjustment arm 554, and a threaded shaft 556. In one embodiment, the threaded shaft 556 is coupled to a spring disk 558. When the threaded shaft 556 is brought into contact with the wedge member 522, the spring disk 558 serves the same function as the spring washer 530 from FIGS. 5-7 by providing preloading the interface between the wedge member 522 and the housing 524. The tightness of the threaded shaft 556 can be adjusted using the adjustment arm 554. Optionally the adjustment arm 554 can include a grip 560 at one or both ends and/or a knob 562 connected to the intermediate portion 552. Additionally part of the adjustment device 550 can be removed by taking the intermediate portion 552 and the adjustment arm 554 off of the threaded shaft 556. The removed components may then be taken to a remote location (e.g., a repair shop) for adjustment or repair.

Figure 15:
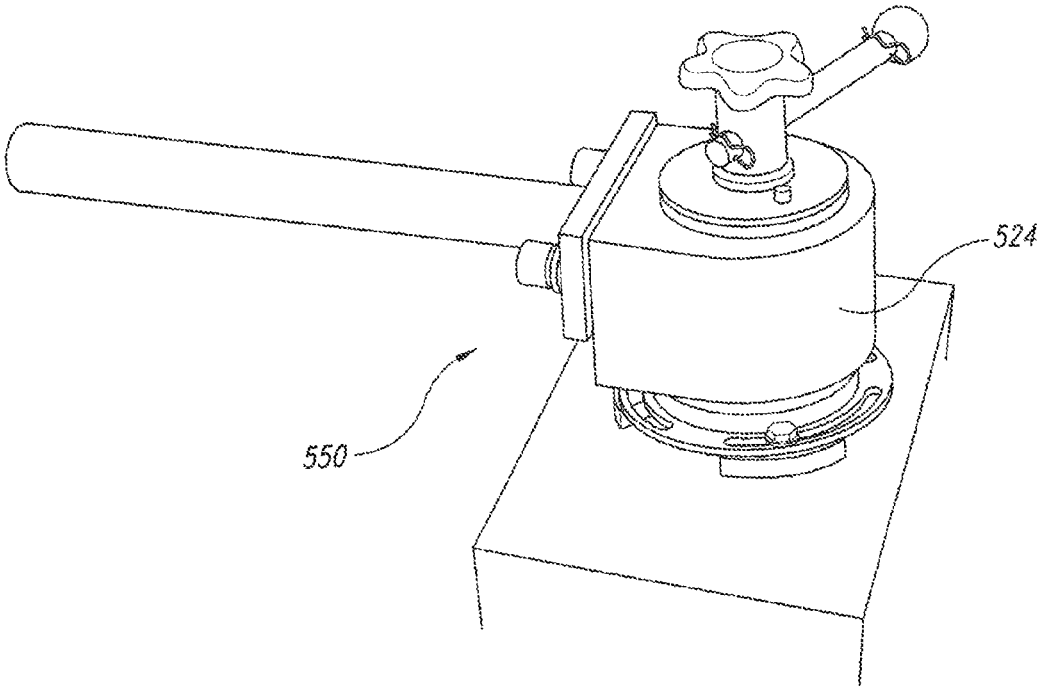
FIG. 15 is another a perspective view of a wedge member, housing, and adjustment device according to an embodiment of the disclosure.

FIG. 15 shows an additional perspective view of the adjustment device 550 attached to the housing 524. In this embodiment, the adjustment device 550 is attached to come in axial alignment with the wedge member 522 and the housing 524. Attachment at the top of the housing 524 makes the adjustment arm 554 easy and convenient to reach and rotate relative to the housing 524 without interference by the housing 524.

Figure 16:
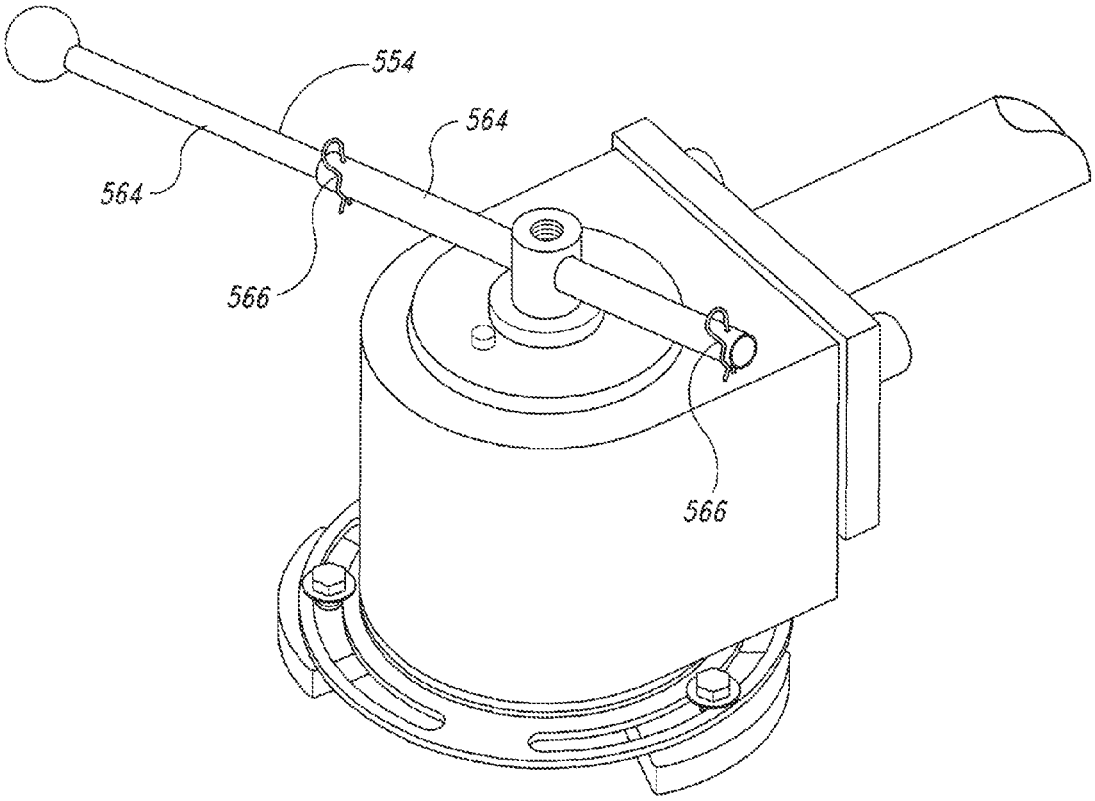
FIG. 16 is yet another perspective view of a wedge member, housing, and adjustment device according to an embodiment of the disclosure.

In one embodiment shown in FIG. 16, the adjustment arm 554 can include one or more telescoping joints 564 which make it adjustable in length. If more leverage is needed to adjust the tightness of the threaded shaft 556, the length of the adjustment arm 554 can be increased. Pins 566 may be used to lock the telescoping joints 564 in an extended position, a retracted position, or in an intermediate position. The adjustment arm 554 may also include other attachments or devices to enhance its functionality.

Figure 17:
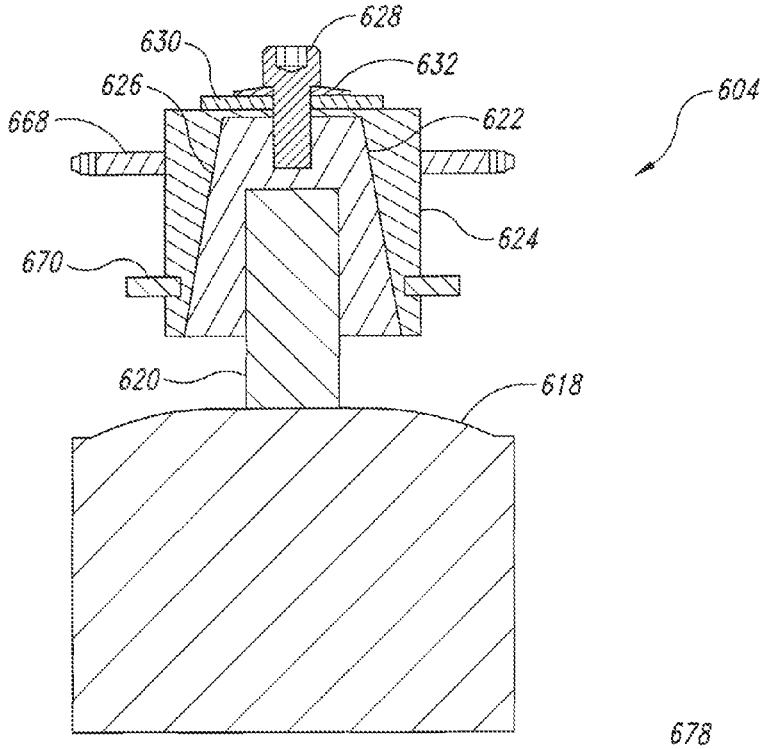
FIG. 17 is a sectional view of another embodiment of the disclosure.

FIG. 17 shows another embodiment of a barrier operator coupling 604 according to the disclosure. The barrier operator coupling 604 includes a wedge member 622 having a male frustoconical shape which is securely mounted to a torque multiplication device 618 with an output shaft 620. The wedge member 622 engages at a wedge interface with a housing 624. A sprocket 668 is attached to the housing 624 for the purpose of transmitting motion to a barrier (not shown). The housing 624 with the sprocket 668 contains a corresponding female frustoconical bore 626 that is brought to bear against the wedge member 622. An axial force is supplied by an adjustment device 628 tightening into the wedge member 622 and transferred through a spring washer 630 and a flat washer 632 to the housing 624. In one embodiment, a fork 670 is used to provide a release mechanism.

Figure 18:
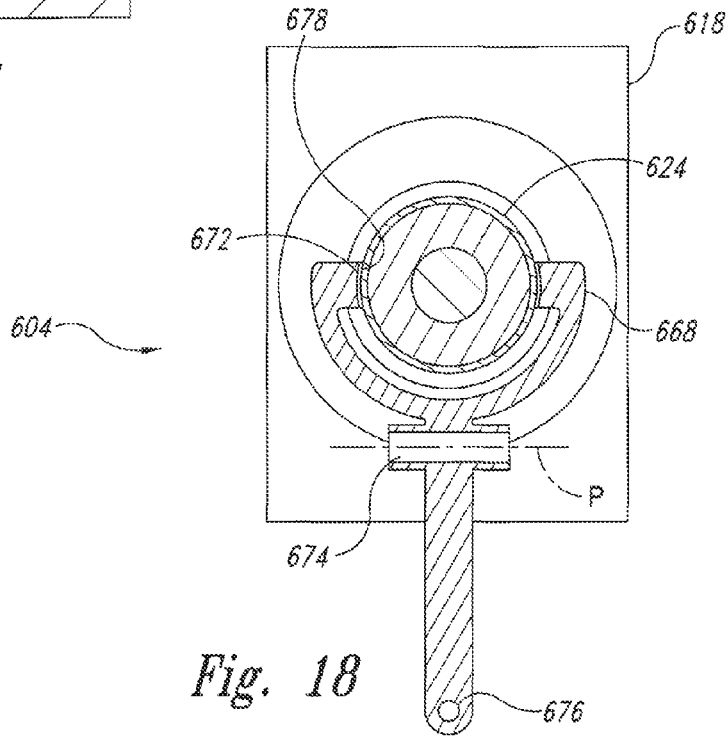
FIG. 18 is a top sectional view of another embodiment of the disclosure.

As shown in FIG. 18, a pair of tangs 672 can be provided to engage a circumferential groove 678 in the housing 624. A pivot axis P is fixed relative to the barrier operator coupling 604 such that motion at an actuating point 676 causes a corresponding motion at the tangs 672. This will cause the housing 624 to force compression on the spring washer 630 and allow a separation of the wedge member 622 and the housing 624. This is useful to provide immediate and convenient disconnection of the barrier from the operator in event manual operation of the gate is required.

Figure 19:
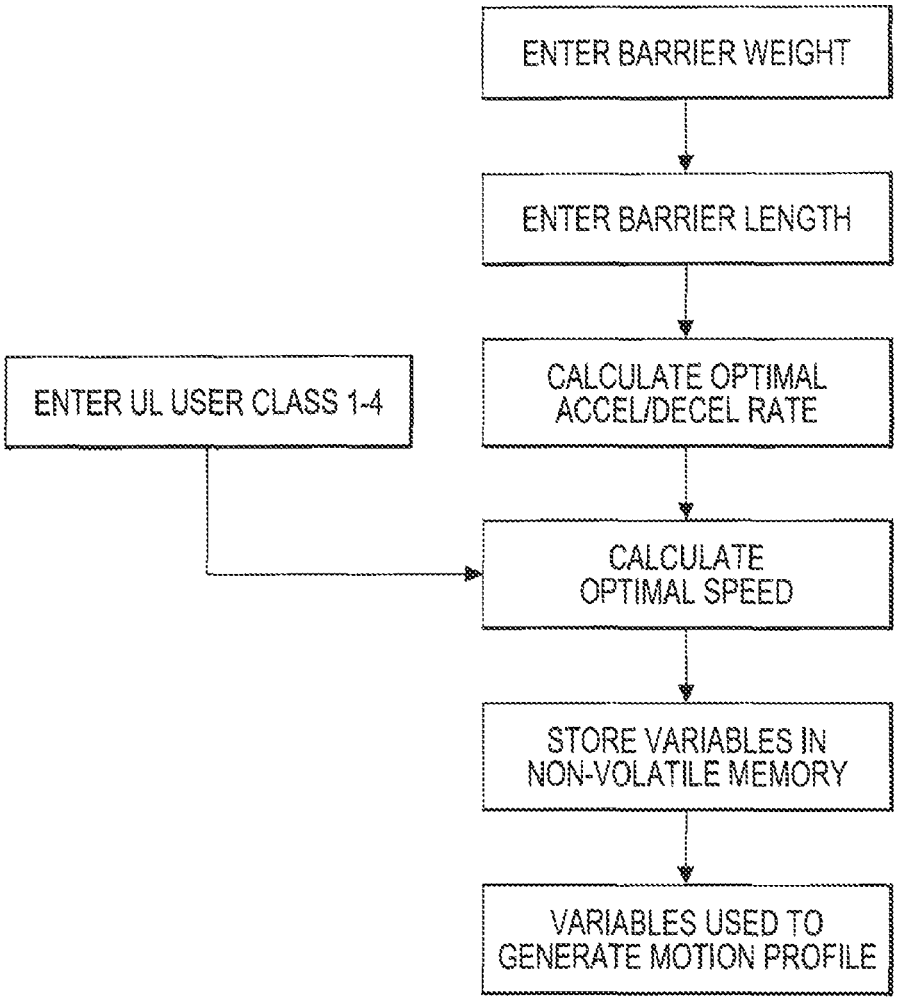
FIG. 19 is a flowchart of a process for determining optimal barrier acceleration and speed.

Another aspect of the disclosure relating to a process for determining optimal barrier acceleration and speed is disclosed in FIG. 19. During the setup of the barrier operator 502 as shown in FIG. 5, a user interface is provided for the purpose of setting various parameters related to the function of the barrier 514 in a particular installation. One of these setup parameters is to enter the weight of the barrier 514. Entering of the weight can be accomplished in a variety of ways. A keypad could be used to enter numbers, buttons could increment or decrement numbers on a display, a rotary switch or series of DIP switches could be used. Once the weight is entered, the barrier length is entered in a similar fashion.

Once the weight and length are entered, a controller in the barrier operator 502 performs a calculation to determine the maximum acceleration ramp rate (the time it takes the barrier 514 to move from a stop to its maximum speed) and maximum deceleration ramp rates (the time it takes the barrier 514 to move from its maximum speed to a stop). The amount of linear force or rotary torque provided by the barrier operator 502 is limited by the capability of the motor 516, available electrical energy, and drive train strength so there is a maximum force, F or torque T available. If the mass of the barrier 514 is known, one may calculate the maximum acceleration ramp rate of the barrier 514.

Figure 20:
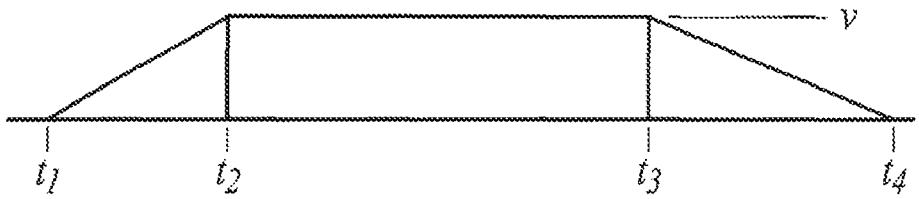
FIG. 20 is a graphical representation of a motion profile.

In the case of linear motion, the force is given by F=ma. Rearranging this equation gives a=F/m. The acceleration a defines the slope of the acceleration line shown in FIG. 20. Referring to FIG. 20, an acceleration period is defined from the time $t_1$ until time $t_2$ as:

$$\text{Acceleration Period} = \frac{v - 0}{t_2 - t_1}$$

This maximum acceleration ramp rate is determined based on the mass (linear motion) or inertia (rotary motion) of the barrier 514 using the fundamental Newtonian equations for acceleration and recognizing that the motor 516 is limited to supplying a certain maximum amount of force or torque to accomplish the acceleration.

In the case of a barrier 514 using linear motion, the acceleration is dependent on the mass of the barrier 514. The speed v is selected by inputting the maximum allowable speed based on the conditions of the barrier operation installation 500. For example, the maximum allowable speed in a residential application may be approximately 12 inches per second, whereas the maximum allowable speed in a commercial application may be approximately 24 inches per second. Once the maximum speed and acceleration are known, one can solve for the time it takes the barrier 514 to reach that speed. Thus, the acceleration ramp rate is known.

In the case of a barrier 514 using rotary motion, the calculation is slightly different. In rotary motion, the angular acceleration is given by $T=I\alpha$, where I is the mass moment of inertia about the centerline and $\alpha$ is the angular acceleration in radians/sec$^2$. The maximum angular acceleration is a where $\alpha=T/I$. The angular acceleration is based on the polar mass moment of inertia about the hinge centerline, $$I_{aa} = \frac{ml^2}{3}$$

Where aa denotes the hinge axis
m is the mass of the barrier
l is the length of the barrier Once the maximum speed and angular acceleration are known, one can solve for the time it takes the barrier 514 to reach that speed in a manner similar to the linear motion scenario.

In another embodiment, the deceleration ramp rate may be calculated in a similar manner. In a likewise fashion, the barrier operator 502 is only capable of supplying a certain decelerating force or torque, and that force or torque, coupled with the known speed will define a given deceleration period ($t_4-t_3$) in which to bring the barrier to rest. The maximum deceleration ramp rate is determined based on the mass (linear motion) or inertia (rotary motion) of the barrier 514. Referring to FIG. 20, the deceleration period is defined as:

$$\text{Deceleration Period} = \frac{0 - v}{t_4 - t_3}$$

As described above in the acceleration example, the speed v is selected by inputting the maximum allowable speed based on the conditions of the barrier operation installation 500. If the mass of the barrier 514 is known, the time required for the barrier 514 to move from its maximum speed to a stop can be calculated. The controller will then begin the deceleration at the appropriate point $t_3$ so as to decelerate the barrier within its capability.

In other embodiments, the barrier operator installation includes a movable barrier operator including a motor for the purpose of supplying mechanical energy to the operator to move the barrier, a transmission for reducing the motor speed and multiplying the torque, a coupling between the transmission and the barrier that allows slippage at a predetermined torque level, said coupling incorporating a conical shaped journal, a second member with an internal matching conical shaped hole which is brought to bear in a mating relationship on the conical shaped journal, and a means of providing an axial force engaging the second member with said conical shaped journal. Said second member is then attached to the barrier. In some embodiments, the means of providing an axial force is provided by a screw mechanism clamping the second member with said conical shaped journal. The axial force is adjustably provided by a compressible spring. The spring is able to be overcome by an external linkage, thereby disengaging the coupling. In some embodiments, the material of the conical shaped journal is relatively harder than that of the mating member. In some embodiments, the material of the conical shaped journal is relatively softer than that of the mating member. In some embodiments, any components used to provide or transmit said axial force are restricted from motion relative to said conical shaped journal. In some embodiments, an input is made to the controller signifying either or both of the following parameters: length or weight and this input is used to adjust either of the following: speed or acceleration rate or deceleration rate. The input made to the controller may signify either or both of the following parameters: length or weight and this input is used to adjust either of the following: speed or acceleration rate or deceleration rate.

In other embodiments, the disclosure includes an apparatus for coupling a barrier movement operator to the barrier it is designed to move is disclosed. The apparatus includes a tapered frustoconical-shaped journal to which a mating female member is engaged. This second frustoconical-shaped member is attached to the portion of the operator that actuates the barrier. A means of applying an axial force between the armature and the second member allows a measure of torque to be transmitted through the interface between the two members, yet allows for motion between the two in the event of an unanticipated force applied to the barrier. In a second aspect of the disclosure, a barrier movement operator calculates the amount of inertia of the barrier and determines the optimum motion profile to minimize the time the barrier is open.

Figure 21A:
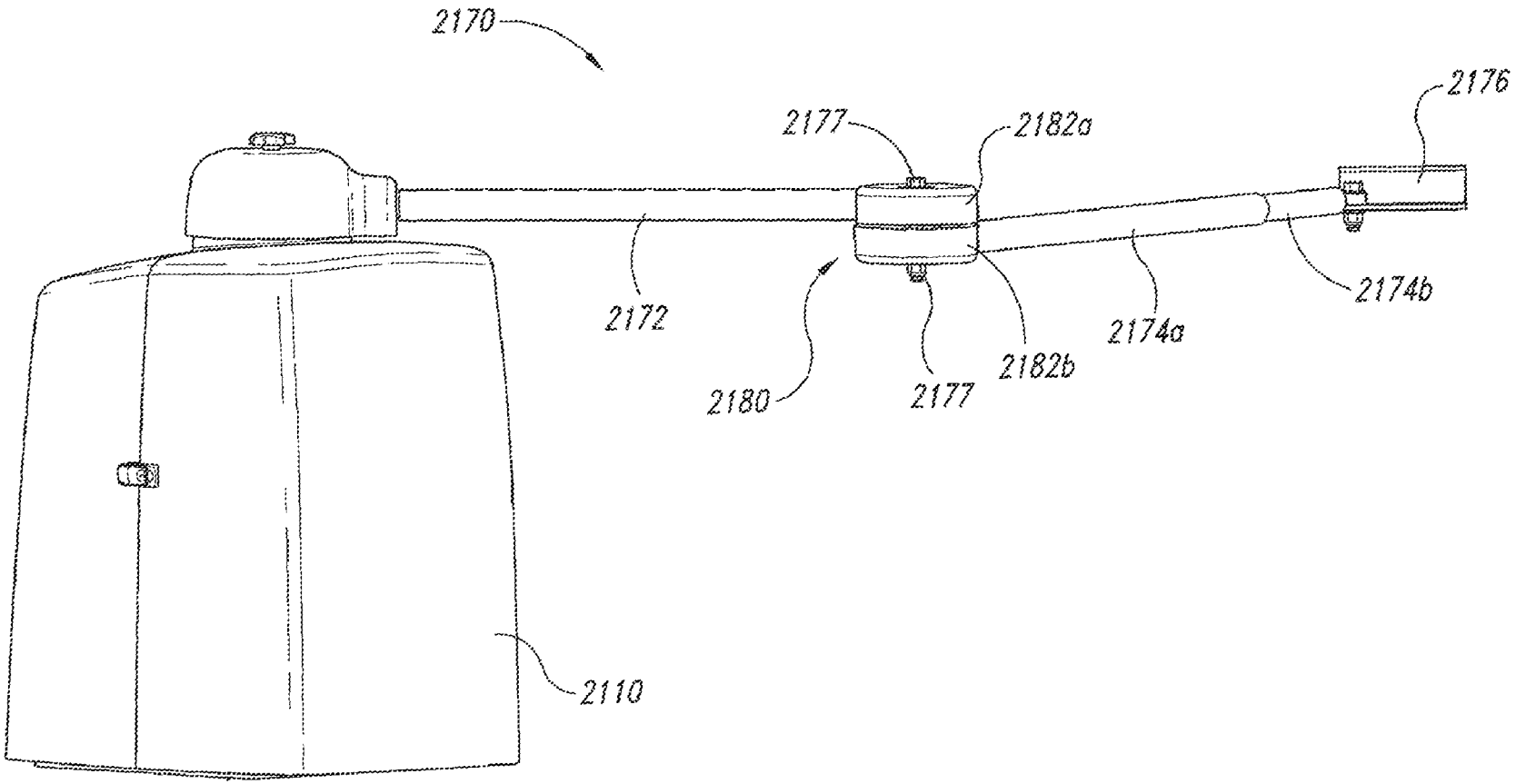
FIG. 21A is a perspective view and FIG. 21B is a partially exploded perspective view of a barrier linkage configured in accordance with another embodiment of the disclosure.
Figure 21B:
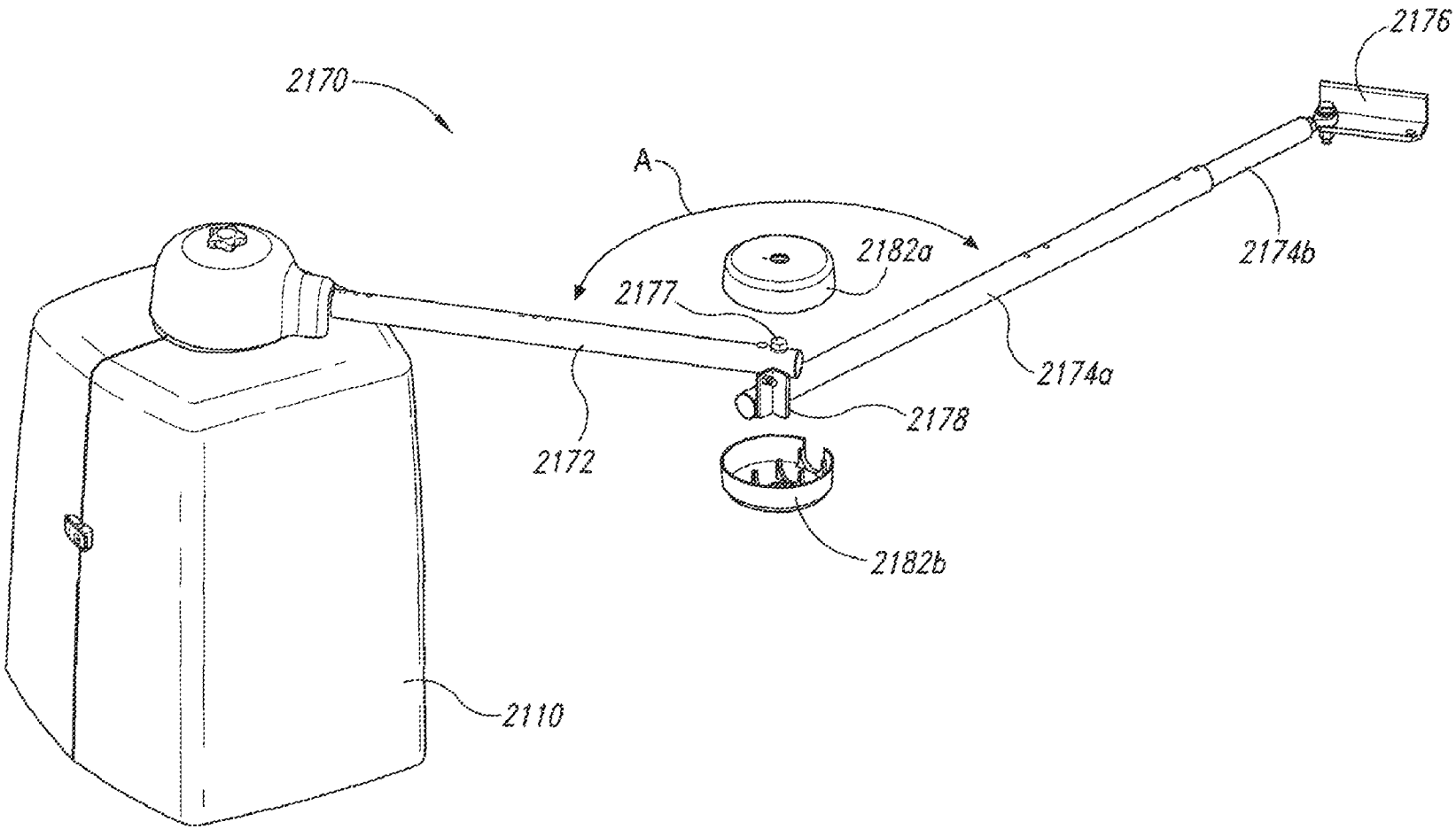

FIG. 21A is a perspective view and FIG. 21B is a partially exploded perspective view of a barrier linkage 2170 configured in accordance with another embodiment of the disclosure. Referring to FIGS. 21A and 21B together, several components of the linkage 2170 are generally similar in structure and function to the corresponding components described above with reference to FIGS. 1-20. For example, the linkage 2170 includes a first crank arm 2172 that is operably coupled to a barrier operator 2110. Although only a first crank arm 2172 is shown, the linkage 2170 can also include a second crank arm that couples the first crank arm 2172 to the operator 2110. The first crank arm 2172 is further pivotally coupled to a first barrier arm 2174*a* with a pivot fastener 2177 (e.g., a bolt, screw, pin, rivet, etc.). The first barrier arm 2174*a* is also coupled to a second barrier arm 2174*b*, which is in turn coupled to a connector 2176. The connector 2176 is configured to be attached to a barrier or gate. The combinations of the first crank arm 2172 and the second crank arm, as well as the first barrier arm 2174*a* and the second barrier arm 2174*b*, provide adjustable lengths in the axial direction of these arms to accommodate different sized barriers and/or surroundings where the linkage 2170 is assembled. According to one feature of the illustrated embodiment, the first crank arm 2172, the first barrier arm 2174*a*, and the second barrier arm 2174*b* each has a round cross-sectional shape. In other embodiments, however, these arms can have other cross-sectional shapes including, for example, square, rectangular, polygonal, oblong, elliptical, etc.

The linkage 2170 also includes a stop 2178 (FIG. 21B) near the pivot point or joint between the first crank arm 2172 and the first barrier arm 2174*a*. In the illustrated embodiment, the stop 2178 is attached (e.g., welded, bolted, screwed, riveted, etc.) to the first barrier arm 2174*a* and is configured to contact the first crank arm 2172 to limit the range of motion between the first crank arm 2172 and the first barrier arm 2174*a* during operation. More specifically, as the first crank arm 2172 and the first barrier arm 2174*a* pivot relative to each other, an angle "A" (FIG. 21B) changes between these arms. In one embodiment, the stop 2178 contacts the first crank arm 2172 when the angle "A" is approximately 180 degrees. In other embodiments, however, the stop 2178 can be configured to limit the range of movement such that the angle "A" is less than or greater than 180 degrees. Accordingly, the stop 2178 can prevent the linkage 2170 from pivoting beyond a predetermined angle "A" and damaging the operator 2110. Moreover, although the illustrated embodiment shows the stop 2178 attached to the first barrier arm 2174*a*, in other embodiments the stop 2178 can be attached to the first crank arm 2172.

According to another feature of the illustrated embodiment, the linkage 2170 includes a cover assembly 2180 at the pivot point between the first crank arm 2172 and the first barrier arm 2174*a*. The cover assembly 2180 includes a first cover 2182*a* opposite a second cover 2182*b*. In the illustrated embodiment, the first cover 2182*a* is attached to the first crank arm 2172, and the second cover 2182*b* is attached to the first barrier arm 2174*a*. Accordingly, the first cover 2182*a* and the second cover 2182*b* rotate relative to each other as the first crank arm 2172 and the first barrier arm 2174*a* pivot during operation. The cover assembly 2180 is configured to envelop or cover the end portions of the first crank arm 2172 and the first barrier arm 2174*a*, as well as the stop 2178. In certain embodiments, the cover assembly 2180 is large enough to completely cover at least the stop 2178. In other embodiments, however, the cover assembly 2180 can be sized such that it covers any overlapping portions of the first crank arm 2172 and the first barrier arm 2174*a* throughout the movement of the linkage 2170. In this manner, the cover assembly 2180 provides the benefit of preventing any obstruction between the first crank arm 2172, the first barrier arm 2174*a*, and/or the stop 2178 during operation of the linkage 2170. For example, the cover assembly 2180 protects the pivot point of the linkage 2170 from obstructions such as branches, leaves, rain, snow, ice, etc. from interfering with the linkage 2170.

Figure 22:
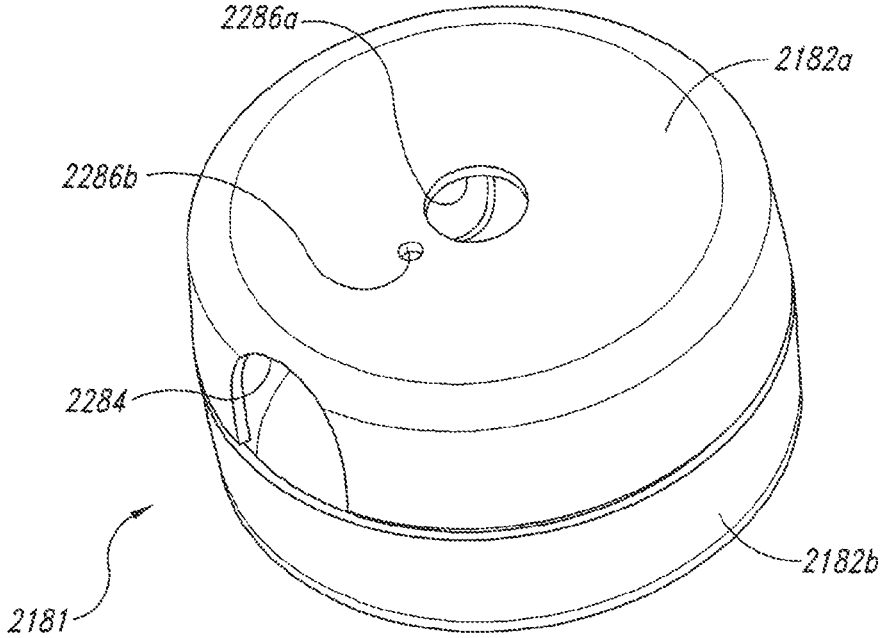
FIG. 22 is a perspective view of a cover assembly of the barrier linkage of FIGS. 21A and 21B.

FIG. 22 is a perspective view of the cover assembly 2180 of the linkage 2170 shown in FIGS. 21A and 21B. The first cover 2182*a* includes the same features as the second cover 2182*b*, and therefore the description of the features of the first cover 2182*a* also applies to the corresponding features of the second cover 2182*b*. In the illustrated embodiment, the first cover 2182*a* includes a first fastener opening 2286*a* and a second fastener opening 2286*b*. The first fastener opening 2286*a* is configured to provide clearance for the pivot fastener 2177 pivotally coupling the first crank arm 2172 to the first barrier arm 2174*a* (FIGS. 21A and 21B). Accordingly, in certain embodiments the first fastener opening 2286 can be sized to be slightly larger than the pivot fastener 2177. In other embodiments, however, the first fastener opening 2286*a* can be omitted and the first cover 2182*a* can be sized to accommodate the pivot fastener 2177 within the first cover 2182*a*. Moreover, in certain embodiments, the first cover 2182*a* and the second cover 2182*b* can be made from a plastic material, including for example, injection molded thermosets or thermoplastics. In other embodiments, however, these covers can be made from other materials including, for example, metals or metallic alloys.

The second fastener opening 2286*b* is configured to receive a fastener (e.g., bolt, screw, pin, rivet, etc.) to attach the first cover 2182*a* to the first crank arm 2172. In other embodiments, however, the first cover 2182*a* can be attached to the first crank arm 2172 with other mechanisms, including, for example, an adhesive. As also shown in the illustrated embodiment, the first cover 2182*a* includes an arm opening 2284 that is configured to receive the first crank arm 2172. In certain embodiments, at least a portion of the arm opening 2284 has an arched shape that corresponds to the round cross-sectional shape of the first crank arm 2172.

Figure 23:
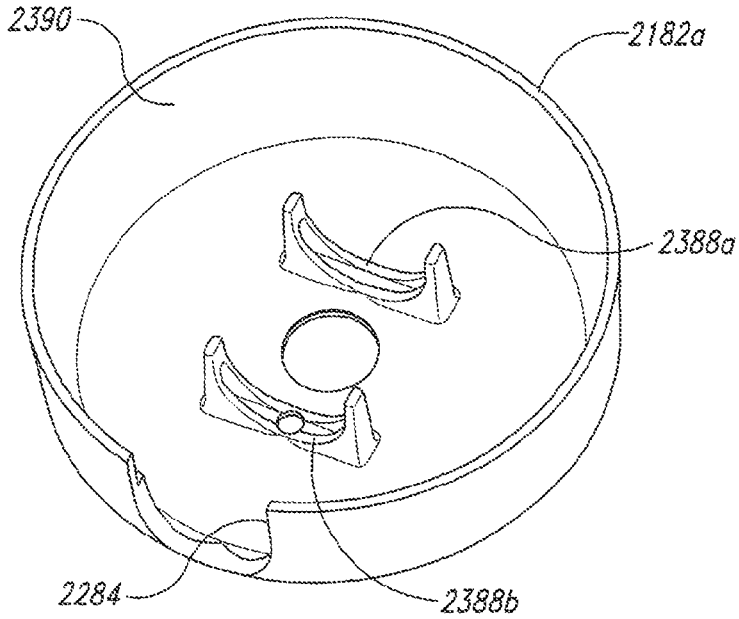
FIG. 23 is a perspective view of a first cover of the cover assembly of FIG. 22.

FIG. 23 is a perspective view of the first cover 2182*a* illustrating several features of the interior of the first cover 2182*a*. As noted above, the first cover 2182*a* includes features analogous to the features of the second cover 2182*b*. As shown in FIG. 23, the arm opening 2284 extends through a sidewall 2390 of the first cover 2182*a*. The first cover 2182*a* also includes attachment portions 2388 (identified individually as a first attachment portion 2388*a* and a second attachment portion 2388*b*) extending away from an interior surface 2392 of the first cover 2182*a*. The attachment portions 2388 are configured to receive the first crank arm 2172. For example, in the illustrated embodiment, each of the attachment portions 2388 has an arched or u-shaped design that generally matches the round cross-sectional shape of the first crank arm 2172. In other embodiments, however, the attachment portions 2388 can have other suitable shapes configured to receive the corresponding linkage arm.

From the forgoing it will be appreciated that specific embodiments of the disclosure have been described herein for purposes of illustration but that various modifications may be made without deviating from the disclosure. For example, the components may have different shapes or arrangements than are shown in the Figures. Aspects of the disclosure described in the context of particular embodiments may be combined or eliminated in other embodiments. Further, while advantages associated with certain embodiments of the disclosure may have been described in the context of those embodiments, other embodiments may also exhibit such advantages, and not all embodiments need necessarily exhibit such advantages to fall within the scope of the disclosure. Accordingly, the disclosure can include other embodiments not expressly shown or described above.

We claim:

1. A barrier system comprising:

a barrier operator having an output shaft;

a journal coupled to the output shaft, wherein the journal includes a generally frustum-shaped exterior surface;

a housing coupled to the journal, wherein the housing includes a bore portion that receives the journal and frictionally engages the exterior surface of the journal;

a linkage having a first end portion opposite a second end portion, wherein the first end portion is coupled to the housing; and a barrier coupled to the second end portion of the linkage, wherein the barrier is configured to move between a closed position and an open position;

wherein the housing slips along the journal and rotates independent of the journal when a torque above a predetermined value is applied to the housing via the linkage.

2. The barrier system of claim 1 wherein the journal is made from a first material having a first hardness and the housing is made from a second material having a second hardness different from the first hardness.

3. The barrier system of claim 1 wherein one of the journal and the housing is made of steel and the other is made of aluminum.

4. The barrier system of claim 1 wherein the journal is configured to rotate the housing and drive the linkage to move the barrier between first and second positions.

5. The barrier system of claim 1 wherein the journal includes an axis extending generally perpendicularly from a lower surface of the journal, and wherein the exterior surface of the journal is at a cone angle of approximately 5-10 degrees from the axis.

6. The barrier system of claim 1, further comprising an adjustment assembly coupling the housing to the journal, wherein the adjustment assembly is configured to adjust a frictional force between the journal and the housing.

7. The barrier system of claim 6, wherein the adjustment assembly comprises:

a fastener threadably engaged with the journal; and a washer positioned between the fastener and the housing, wherein the washer transfers an axial force from the fastener to the housing to adjust the frictional force between the journal and the housing.

8. The barrier system of claim 1 wherein:

the linkage includes a crank arm coupled to the barrier operator and a barrier arm coupled to the barrier, and wherein the barrier arm is coupled to the crank arm at a pivot point; and the barrier system further comprises a cover assembly coupled to the linkage at the pivot point, and wherein the cover assembly at least partially covers any overlapping portions of the crank arm and the barrier arm throughout movement of the linkage during operation of the barrier operator.

9. A barrier system comprising:

a barrier operator having an output shaft;

a journal coupled to the output shaft, wherein the journal includes a frustum-shaped exterior surface;

a housing coupled to the journal, wherein the housing includes a bore portion that receives the journal and frictionally engages the exterior surface of the journal;

a linkage having a first end portion opposite a second end portion, wherein the first end portion is coupled to the housing;

a barrier coupled to the second end portion of the linkage, wherein the barrier is configured to move between a closed position and an open position;

an adjustment assembly coupling the housing to the journal, wherein the adjustment assembly is configured to adjust a frictional force between the journal and the housing, the adjustment assembly comprising a fastener threadably engaged with the journal, a washer positioned between the fastener and the housing, wherein the washer transfers an axial force from the fastener to the housing to adjust the frictional force between the journal and the housing, and wherein the adjustment assembly further comprises a locking member extending through the washer into the journal, wherein the locking member prevents the washer from moving independently from the journal.

10. A barrier system comprising:

a barrier operator having an output shaft;

a journal coupled to the output shaft, wherein the journal includes a frustum-shaped exterior surface;

a housing coupled to the journal, wherein the housing includes a bore portion that receives the journal and frictionally engages the exterior surface of the journal;

a linkage having a first end portion opposite a second end portion, wherein the first end portion is coupled to the housing;

a barrier coupled to the second end portion of the linkage, wherein the barrier is configured to move between a closed position and an open position;

an adjustment assembly coupling the housing to the journal, wherein the adjustment assembly is configured to adjust a frictional force between the journal and the housing, the adjustment assembly comprising a fastener threadably engaged with the journal, a washer positioned between the fastener and the housing, wherein the washer transfers an axial force from the fastener to the housing to adjust the frictional force between the journal and the housing; and a biasing member positioned between the fastener and the washer, and wherein the biasing member urges the washer away from the fastener toward the housing.

11. A barrier system comprising:

a gate configured to move from a first position to a second position;

a linkage coupled to the gate;

a gate operator coupled to the linkage to drive the linkage and move the gate between the first and second positions, wherein the gate operator includes a first torque transmitter coupled to an output of the gate operator, wherein the first torque transmitter has a generally cylindrical shape tapering from a lower portion to an upper portion of the first torque transmitter; and a second torque transmitter frictionally engaged with the first torque transmitter, wherein the second torque transmitter is coupled to the linkage, wherein the second torque transmitter is configured to slip against the first torque transmitter and rotate independently from the first torque transmitter when a torque applied to the second torque transmitter is above a predetermined level.

12. The barrier system of claim 11 wherein the first torque transmitter is a generally frustum-shaped torque transmitter and the second torque transmitter includes a generally frustum-shaped cavity that receives the first torque transmitter and corresponds to the shape of the first torque transmitter.

13. The barrier system of claim 11 wherein the first torque transmitter is configured to rotate the second torque transmitter when the output rotates the first torque transmitter.

14. The barrier system of claim 11, further comprising an adjustment assembly configured to adjust a frictional force between the first and second torque transmitters.

15. The barrier system of claim 11 wherein:

the linkage includes a crank arm coupled to the gate operator and a barrier arm coupled to the barrier, and wherein the barrier arm is coupled to the crank arm at a pivot point; and the barrier system further comprises a cover assembly coupled to the linkage at the pivot point, and wherein the cover assembly at least partially covers any overlapping portions of the crank arm and the barrier arm throughout movement of the linkage during operation of the gate operator.

16. A barrier operator for moving a barrier between an open position and a closed position via a barrier linkage, the barrier operator comprising:

a torque multiplying device;

an output shaft extending from the torque multiplying device;

a first torque transmitting device attached to the output shaft, wherein the first torque transmitting device includes a first end portion opposite a second end portion, the first end portion having a first outer diameter and the second end portion having a second outer diameter that is less than the first outer diameter; and a second torque transmitting member operably coupled to the first torque transmitting member, wherein the second torque transmitting member includes a bore portion that at least partially receives the first torque transmitting device, and wherein the second torque member is configured to be coupled to the barrier linkage to move the barrier between the open and closed positions;

wherein the first and second torque transmitting devices are configured to slip and rotate relative to each other when a predetermined amount of torque is applied to at least one of the first and second torque transmitting devices.

17. The barrier operator of claim 16 wherein an exterior surface of the first torque transmitting device frictionally engages the bore portion of the second torque transmitting device.

18. The barrier operator of claim 16 wherein the first torque transmitting device has a generally frustum shape.

19. The barrier operator of claim 16 wherein the first torque transmitting device is made from a first material having a first hardness, and the second torque transmitting device is made from a second material having a second hardness that is different than the first hardness.

20. The barrier system of claim 16, further comprising an adjustment assembly coupling the first torque transmitting device to the second torque transmitting device, wherein the adjustment assembly is configured to adjust a normal force between an exterior surface of the first torque transmitting device and an interior surface of the bore portion of the second torque transmitting device.

21. The barrier operator of claim 16 wherein the second torque transmitting device is configured to be separable from the first torque transmitting device to interrupt torque transmission between the first and second torque transmitting devices.

22. A barrier operator for moving a barrier between an open position and a closed position via a barrier linkage, the barrier operator comprising:

a torque multiplying device;

an output shaft extending from the torque multiplying device;

a first torque transmitting device attached to the output shaft, wherein the first torque transmitting device includes a first end portion opposite a second end portion, the first end portion having a first outer diameter and the second end portion having a second outer diameter that is less than the first outer diameter; and a second torque transmitting member operably coupled to the first torque transmitting member, wherein the second torque transmitting member includes a bore portion that at least partially receives the first torque transmitting device, and wherein the second torque member is configured to be coupled to the barrier linkage to move the barrier between the open and closed positions, and wherein the second torque transmitting device is separable from the first torque transmitting device;

the second torque transmitting device includes a groove extending circumferentially around an exterior surface of the second torque transmitting device; and the barrier operator further comprises a release linkage including a first engagement portion opposite a second engagement portion, wherein the first and second engagement portions are configured to engage the groove at opposite sides of the second torque transmitting device, and wherein the release linkage is configured to separate the second torque transmitting device from the first torque transmitting device when the release linkage is actuated about a pivot axis.

23. A barrier operator for moving a barrier between an open position and a closed position via a barrier linkage, the barrier operator comprising:

a torque multiplying device;

an output shaft extending from the torque multiplying device;

a first torque transmitting device attached to the output shaft, wherein the first torque transmitting device includes a first end portion opposite a second end portion, the first end portion having a first outer diameter and the second end portion having a second outer diameter that is less than the first outer diameter; and a second torque transmitting member operably coupled to the first torque transmitting member, wherein the second torque transmitting member includes a bore portion that at least partially receives the first torque transmitting device, and wherein the second torque member is configured to be coupled to the barrier linkage to move the barrier between the open and closed positions; an input device configured to receive one or more operating conditions including at least at least one of a weight of the barrier, a length of the barrier, and a maximum allowable speed of the barrier; and a controller configured to control the barrier operator to move the barrier according to a motion profile based on the one or more operating conditions.

24. The barrier operator of claim 23 wherein the motion profile includes at least one of acceleration portion and a deceleration portion of movement the barrier.

* * * * *